US006449809B2

(12) United States Patent
Thalheim

(10) Patent No.: US 6,449,809 B2
(45) Date of Patent: Sep. 17, 2002

(54) BRACELET CLOSURE

(75) Inventor: Jean-François Thalheim, Lignieres (CH)

(73) Assignee: Conseils et Manufactures VLG S.A., Neuchatel (CH)

( * ) Notice: Subject to any disclaimer, the term of this patent is extended or adjusted under 35 U.S.C. 154(b) by 0 days.

(21) Appl. No.: 09/812,838

(22) Filed: Mar. 21, 2001

(30) Foreign Application Priority Data

Mar. 23, 2000 (EP) ..... 00106275

(51) Int. Cl.[7] ..... A44C 5/24
(52) U.S. Cl. ..... 24/71 J
(58) Field of Search ..... 24/68 R, 70 R, 24/70 SK, 70 TT, 70 J, 69 ST, 69 SK, 71 R, 71 ST, 71 J, 71 SK, 68 J, 68 SK, 68 E, 265 WS, 191, 193; 63/3.1, 3.2

(56) References Cited

U.S. PATENT DOCUMENTS

| | | | |
|---|---|---|---|
| 2,532,840 A | | 11/1950 | Gaun |
| 5,579,559 A | * | 12/1996 | Ferrario |
| 5,689,859 A | | 11/1997 | Cuche |
| 5,749,128 A | * | 5/1998 | Cuche |

FOREIGN PATENT DOCUMENTS

| | | | |
|---|---|---|---|
| DE | 197 29 903 | | 1/1999 |
| EP | 0 115 740 | | 8/1984 |
| EP | 0914781 A1 | * | 5/1999 |
| JP | 11-318522 | * | 11/1999 |

* cited by examiner

*Primary Examiner*—James R. Brittain
(74) *Attorney, Agent, or Firm*—Young & Thompson

(57) ABSTRACT

An expansible closure for a bracelet includes a central portion articulated at at least one of its ends to at least one arm located beside the central portion and adjacent to the central portion in a closed position. The at least one arm includes at least one pin having a locking member that emerges in a rest position under an action of a spring from outside a recess in a lateral section of the at least one arm. The central portion includes a locking device having a pusher, and at least one recess provided in a medial section of the central portion adapted to receive the locking member. The medial section of the central portion includes a notch, in a shape of an inclined plane coacting with the locking member during closing of the closure. In a completely closed position, the locking member extends, under the action of the spring, within the recess of the central portion. The pusher, secured to an actuating member, pushes back the locking member, during actuation, into the recess in the lateral section of the arm to unlock the closure.

15 Claims, 2 Drawing Sheets

BRACELET CLOSURE

BACKGROUND OF THE INVENTION

The present invention relates to a closure permitting connecting the two lengths of a bracelet, particularly a watch bracelet of a chain, of metal or another material.

There are known closures of this type generally called expansible closures. These closures have the drawback that they are inelastic because of their blades, whose variation directly influences the clipping force and hence the safety of the closure. Moreover, these expansible closures with blades are relatively fragile, the blades being adapted to deform or to twist, thereby altering the operation of the closure.

SUMMARY OF THE INVENTION

The object of the present invention is to overcome the drawbacks of existing expansible closures, to reinforce the rigidity of the closure, to make sure that the locking of the blades of the closure will be independent of the shape and of the elasticity of the blades, whilst permitting easy production and simple manipulation of the closure.

These and other objects, which will become apparent from the description which follows, are obtained by the closure according to the present invention.

BRIEF DESCRIPTION OF THE DRAWINGS

The accompanying drawings show schematically and by way of example one embodiment of the expansible closure for a bracelet according to the invention.

DETAILED DESCRIPTION OF THE PREFERRED EMBODIMENTS

Figure 1:
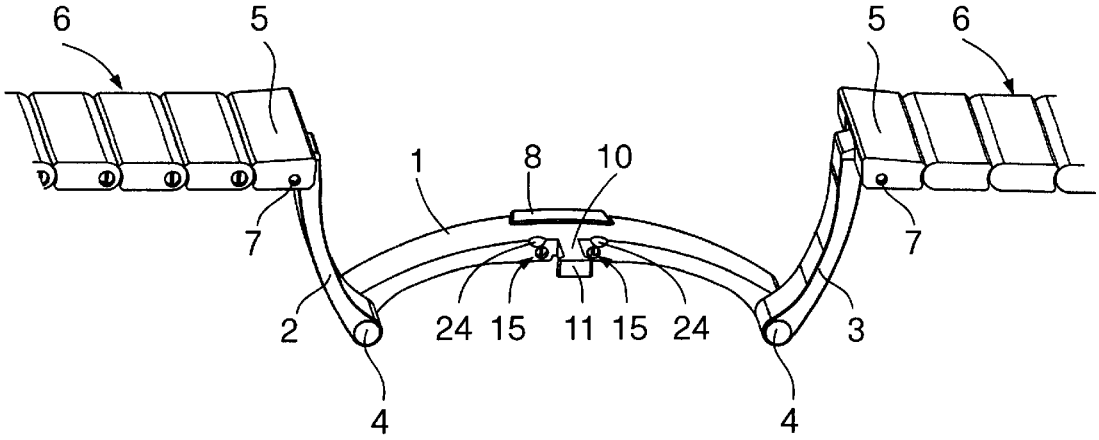
FIG. 1 is a perspective view from above of the partially open closure.
Figure 2:
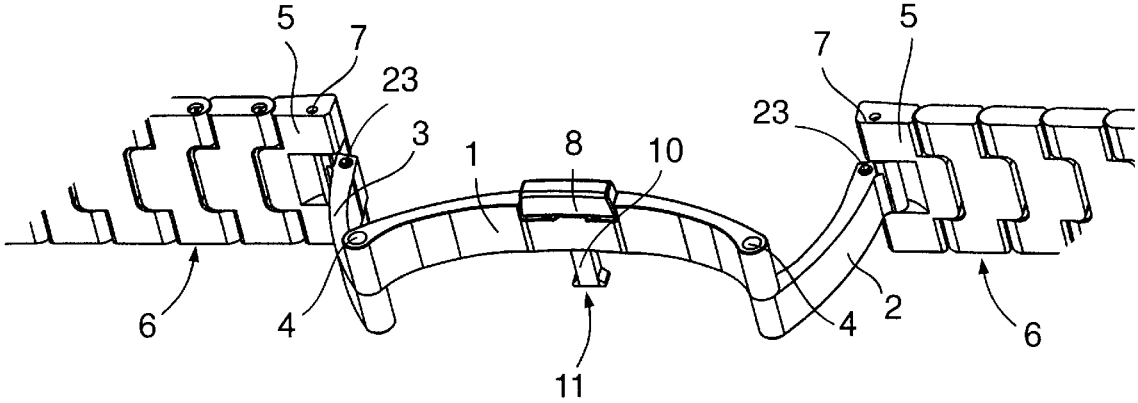
FIG. 2 is a perspective view from below the partially open closure.
Figure 3:
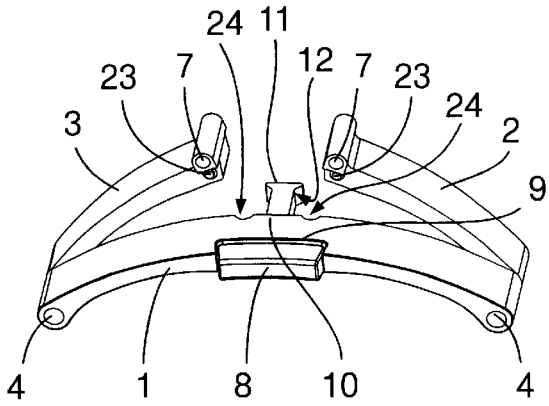
FIG. 3 is a perspective view of the closure alone (without the lengths of the bracelet) partially closed.

The embodiment of the expansible closure according to the invention comprises a central portion 1 and two side arms 2, 3. Each of these side arms is pivoted at one of its ends on one of the ends of the central portion 1, with welded or riveted axles 4, which is to say mounted rigidly and permanently. Generally, this central portion 1 and these arms are incurved to match the rounded shape of the wrist of the user. In closed position, the arms 2, 3 fold back parallel to the central portion, these three pieces are parallel and located in a same surface or plane, the arms 2, 3 being located one in prolongation of the other and side by side along the central portion 1.

The free ends of the arms 2, 3 are articulated in a conventional manner on the last links 5 of a bracelet 6 with the help of pins or screws 7. It should be noted that these arms 2, 3 are located in the plane of symmetry of the bracelet, whilst the central portion of the closure is offset laterally relative to this plane of symmetry of the bracelet, this central portion 1 being of course hidden, in the closed position of the closure, below the edge of the bracelet. This closure thus occupies an asymmetric position relative to the bracelet.

In this construction, the central portion 1 of the closure and its arms 2, 3 are rigid, solid and resistant, which confers a substantial robustness to the closure.

Figure 4:
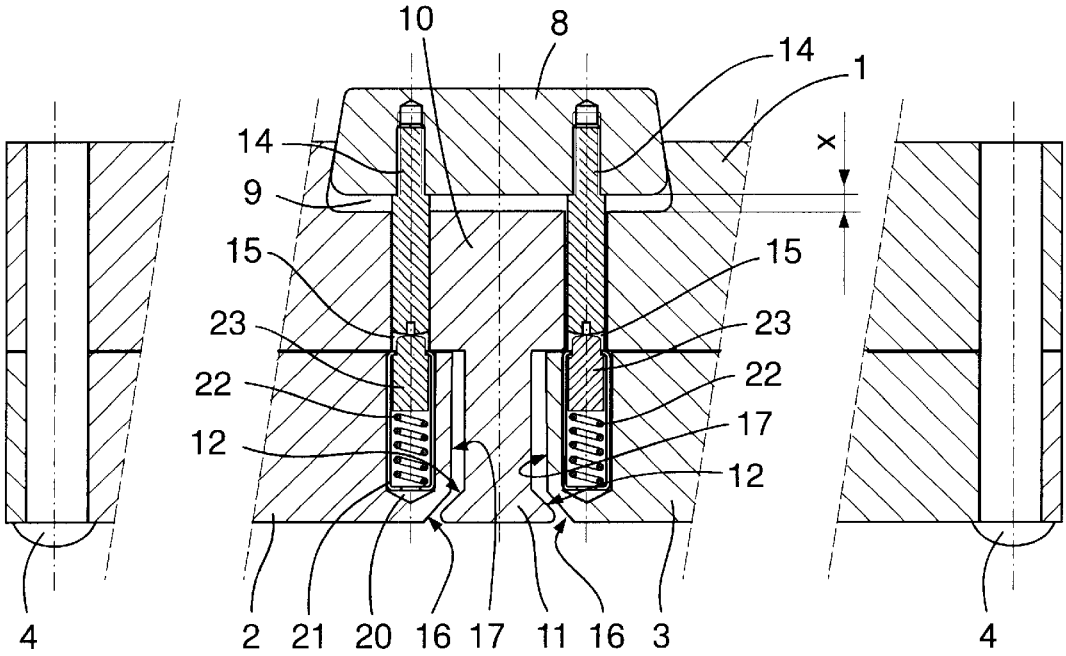
FIGS. 4 and 5 are partial cross-sectional views of the closed closure in the locked and respectively unlocked positions.
Figure 5:
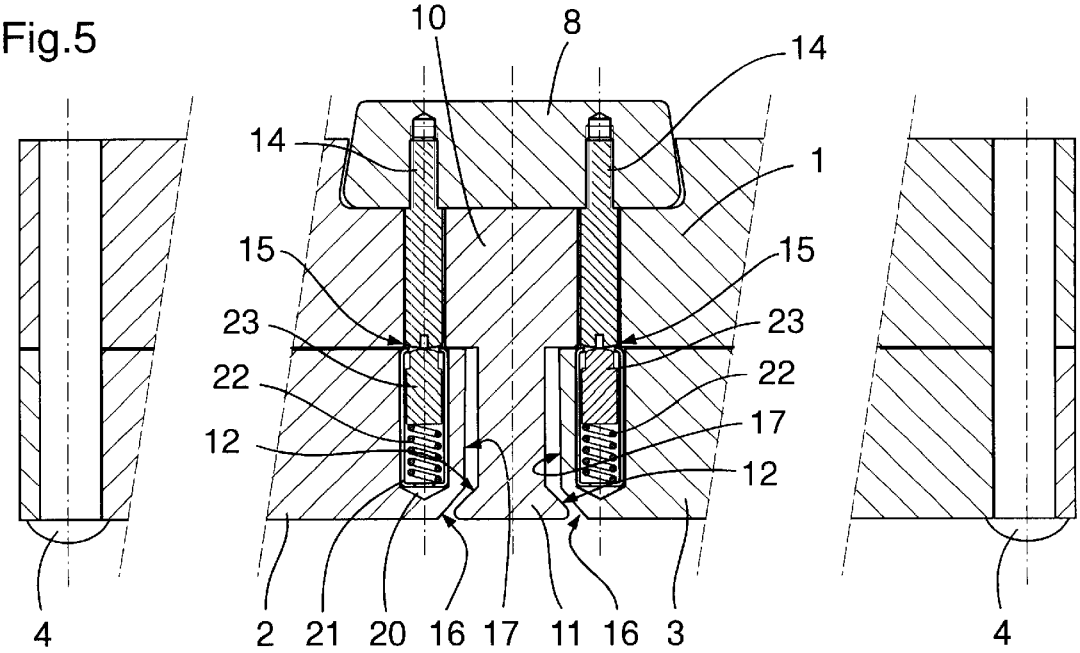

The central or medial portion of the central portion 1 of the closure comprises a locking device for the arms 2, 3 in the closed position. This locking device, shown on a larger scale in FIGS. 4 and 5, comprises a pusher 8 of trapezoidal form disposed in a recess 9 which comprises the central portion 1.

The pusher 8 is maintained in its place with screws 14 passing through the central portion 1 of the closure and whose heads are disposed in recesses 15 provided in the section of the central portion 1 located on the side of the arms 2 and 3. This pusher can move a distance X between its locked position shown in FIG. 4 and its unlocked position of the arms 2, 3 shown in FIG. 5.

In the locked position (FIG. 4), the pusher 8 is retained in the recess 9 by its inclined surfaces and, generally, the head of the screws 14 is located at the bottom of the recesses 15.

The locking device also comprises pins disposed in blind bores 20 provided in the ends of the arms 2, 3 connected to the bracelet and opening on the section of the latter directed toward the central portion 1 of the closure. These pins comprise a sleeve 21 located in the bores 20, enclosing a spring 22 acting on the head of a locking member 23 comprising a finger that can emerge from the sleeve 21 and hence from the arm 2 or 3 under the action of the spring 22.

In the locked position (FIG. 4) the fingers of the locking members 23 extend within the recesses 15 of the central portion 1 of the closure. There is thus obtained a positive locking, which will be secure and independent of the shape or dimensions of the arms 2, 3 and above all extremely strong. The strength of the closure is practically infinite and the closure cannot open untimely.

The central or medial portion of the central portion 1 of the closure also comprises a guide and holding device for the arms 2, 3 in the closed position.

This guiding and holding device is constituted by a rod 10 secured to the central portion 1 and extending perpendicular to the latter outside its surface opposite the pusher 8. This rod 10 ends in a holding formation 11 comprising two inclined surfaces 12.

When the arms 2, 3 are in the closed position, the inclined surfaces 12 of the holding formation 11 of the rod 10 are pressed against the inclined surfaces 16 on the arms 2, 3 at their ends fixed to the bracelet, the rod 10 of the central portion 1 engaging between the end surfaces 17 of these ends of the arms 2, 3.

When the arms 2, 3 are in the closed and locked position, these arms are moreover maintained by the inclined surfaces 12 of the rod 10 coming into contact with the inclined surfaces 16 of the two arms 2, 3 and these latter cannot separate from the central portion of the closure 1.

To open the closure, it is necessary first to unlock and move the pusher 8 against the action of the spring 22 of the pins. When the pusher abuts against the bottom of the recess 9, the head of the screws 14 is located in the plane of the side surface of the arms 2, 3 facing the central portion 1 of the closure and locking members 23 are thus retracted within the arms 2, 3. In this unlocked position, the arms 2, 3 can be freely pivoted on their axle 4, giving rise to opening of the closure.

The side surface of the central portion 1, on which open the recesses 15, also comprises notches 24 whose inclined bottom causes, during closing of the closure, namely the folding down of the arms 2, 3 toward the central portion 1 of the closure, the retraction of the locking members 23 in the sleeves 21 until complete closing of the closure in which the locking members penetrate the recesses 15 while pushing back the screws 14 and hence the pusher 8, and lock the closure in closed position.

In a modification, the closure could comprise only one arm of a length corresponding to that of the central portion. The bracelet would be fixed to the free end of the central portion and to the free end of the single arm. The locking members would be mounted both in the central portion of the single arm, in which there would be but a single locking member.

Numerous modifications of the closure could be envisioned. The external shape of the closure could be anything at all, the length of the arms could also vary. Similarly, the shape of the pusher could be different as well as that of the retention members. The arms could be assembled onto the central portion of the bracelet in any desired manner.

The number of locking members per arm could also vary. The retainer of the pusher is not necessarily in the shape of a dovetail but could have a T shape or another shape. The closure could be flat or incurved or else have another shape.

This closure has numerous advantages relative to the existing closures, of which the principal ones are recited hereafter.

The closure is simple both as to its manufacture and to its handling by the user.

Because of its design, the section of the central portion and of the arm or arms of the closure can be increased relative to an existing expansible closure whilst remaining of the same size. This increases the strength and durability of the closure.

For the user, access to the pusher is facilitated, it does not extend beyond the bracelet because the central portion of the closure is laterally offset.

The action of closing the closure is disassociated from the locking action. In fact, this locking takes place only when the arms reach their closed position parallel to the central portion of the closure.

Locking takes place by locking members independent from the shape, the length and the resiliency of the arm of the closure and its central portion. The closing force is very great, and is independent of the return force of the springs for the pins. The locked position is independent of the closure.

Opening the closure takes place with a single simple pusher, having no springs, which pusher retracts the pins. The return of the pusher to the locking position takes place automatically with the help of the springs of the pins during closing the closure. Locking is ensured automatically.

In the closed position, the arms are guided and held precisely in their positions by a holding member secured to the central portion of the closure.

The arms are preferably assembled only by a smooth axle which has a head at one end and whose other end is welded on the arm or the central portion for example by laser welding. Such a construction is very robust and reliable. It comprises no screw that can unscrew in time.

The length of the arms is not important as a function of the locking but depends solely on the desired expansion for fitting on the wrist. By the use of pins, there is excluded the use of the resilience of the arms and hence the structure is more robust.

The force necessary for closing the closure depends solely on the force of the pin springs and on the slope of the inclined notches giving rise to retraction of the pins. This force can be low. The opening force is given solely by the force of the pin springs. This closure and opening force is independent of the locking force which is much greater and is determined solely by the shear between the pins and the central portion of the closure.

The locking force does not require any adjustment, it can be as large as desired and does not take part in the manipulation of the closure. There is thus no need to adjust this locking force.

The pusher is located in a recess of dovetail shape, avoiding that it be pulled off and defining its path.

This closure is hence easy to use, simple to produce and to mount, avoids any untimely opening and is particularly robust.

What is claimed is:

1. An expansible closure for a bracelet, comprising:

a central portion articulated at at least one end on at least one arm, wherein the at least one arm is located beside the central portion such that in a closed position of the closure, the at least one arm is located parallel to the central portion, adjoining the central portion by a lateral section, wherein the at least one arm comprises at least one pin having a locking member that emerges in a rest position subject to the action of a spring outside said lateral section of the at least one arm, and wherein the central portion comprises a locking device having a pusher movable transversely to the central portion, at least one recess being in a section of the central portion adapted to receive the locking member, said section of the central portion comprising a notch, in the form of an inclined plane coacting with the locking member during closing of the closure, giving rise to the retraction of the locking member which when the closure arrives at the closed position extends, under the action of the spring within the at least one recess of the central portion; and wherein the pusher is secured to at least one actuating member movable within the at least one recess under the action either of the spring and the locking member or of the pusher.

2. The closure according to claim 1, wherein the pusher has a trapezoidal shape and is disposed in a dovetail shape recess in the central portion such that the pusher cannot move laterally in the dovetail shape recess.

3. The closure according to claim 1, wherein the at least one actuating member secured to the pusher passes through the central portion to open into the at least one recess of the central portion.

4. The closure according to claim 1, further comprising a device for guiding and holding the at least one arm in the closed position.

5. The closure according to claim 4, wherein the central portion of the closure comprises a rod extending transversely out of the central portion and provided at an end with holding formations of the at least one arm in the closed position coacting in the closed position of the closure with corresponding formations provided at the end of the at least one arm.

6. The closure according to claim 1, comprising two arms articulated at each end of the central portion.

7. The closure according to claim 1, wherein the at least one arm is located in an axis of symmetry of the bracelet provided with the closure.

8. An expansible closure for a bracelet comprising:

two arms each having a lateral section;

a central portion articulately connected to an end of each of said two arms, wherein the two arms are located adjacent the central portion such that, in a closed position of the closure, the two arms are located parallel to the central portion and adjoin the central portion by a respective one of the lateral sections;

the two arms each comprise a pin within said lateral section, each said pin having a locking member movable from a depressed position to a rest position against an action of a spring, each said pin emerging from outside of said lateral section in the rest position subject to the action of the spring; and the central portion comprises a locking device having a pusher movable transversely to the central portion, and at least one notch in a medial section of the central portion adapted to receive the locking member, said notch is an inclined plane that coacts with the locking member during closing of the closure, to retract the locking member, said locking member extending, under the action of the spring within the recess of the central portion, when the closure is in the closed position; and the pusher is secured to at least one actuating member movable within the recess under the action of at least one of the spring, the locking member and the pusher.

9. The closure according to claim 8, wherein the pusher is trapezoidal shaped and is disposed in a dovetail shaped recess in the central portion, such that the pusher cannot move laterally from the dovetail shaped recess.

10. The closure according to claim 8, wherein the at least one actuating member passes through the central portion to open into the recess.

11. The closure according to claim 8, further comprising a device for guiding and holding the two arms in the closed position.

12. The closure according to claim 11, wherein the device is connected to the central portion and comprises a rod extending transverse to the central portion, and wherein said two arms have formations at an end of each of the two arms, and said rod has holding formations that coact with corresponding formations of said arms, to hold the two arms in the closed position.

13. The closure according to claim 8, wherein the two arms are located in an axis of symmetry of a bracelet having the closure.

14. The closure according to claim 8, wherein the bracelet is one of a watch band and a chain.

15. An expansible closure for a watch band comprising:

at least one arm having a lateral section;

a central portion articulately connected to an end of said at least one arm, wherein said at least one arm is adjacent the central portion such that, in a closed position of the closure, the at least one arm is parallel to the central portion and adjoins the central portion by the lateral section;

said at least one arm comprises a pin within said lateral section, said pin having a locking member movable from a depressed position to a rest position against an action of a spring, each said pin emerging from outside of said lateral section in the rest position;

the central portion comprises a locking device having a pusher movable transversely to the central portion, and at least one notch in a medial section of the central portion adapted to receive the locking member, said notch is an inclined plane that coacts with the locking member during closing of the closure, to retract the locking member, said locking member extending, under the action of the spring, within the recess of the central portion, when the closure is in the closed position; and the pusher is secured to at least one actuating member movable within the recess under the action of at least one of the spring, the locking member and the pusher.

* * * * *